US006692210B1

(12) United States Patent
Ettelbrück

(10) Patent No.: US 6,692,210 B1
(45) Date of Patent: Feb. 17, 2004

(54) DEVICE AND METHOD FOR THE AUTOMATIC CHARGING OF PROCESSING STATIONS WITH PRINTING CYLINDERS

(75) Inventor: Rüdiger Ettelbrück, Aschheim/München (DE)

(73) Assignee: Kaspar Walter GmbH & Co. KG, Munich (DE)

( * ) Notice: Subject to any disclaimer, the term of this patent is extended or adjusted under 35 U.S.C. 154(b) by 0 days.

(21) Appl. No.: 09/485,977

(22) PCT Filed: May 22, 1998

(86) PCT No.: PCT/EP98/03054

§ 371 (c)(1),
(2), (4) Date: Feb. 21, 2000

(87) PCT Pub. No.: WO99/10175

PCT Pub. Date: Mar. 4, 1999

(30) Foreign Application Priority Data

Aug. 22, 1997 (DE) ..... 197 36 698

(51) Int. Cl.[7] ..... B65H 1/00

(52) U.S. Cl. ..... 414/222.01; 414/626; 414/806; 414/909; 414/910; 414/911; 483/14

(58) Field of Search ..... 414/222.01, 222.07, 414/222.08, 222.13, 225.01, 626, 749.1, 806, 908, 909, 910, 911; 212/77; 483/14

(56) References Cited

U.S. PATENT DOCUMENTS 5,274,984 A * 1/1994 Fukuda ..... 53/451
5,336,898 A * 8/1994 Ettelbrueck ..... 250/559.26
5,549,044 A 8/1996 Achelpohl

FOREIGN PATENT DOCUMENTS

| | | | |
|---|---|---|---|
| CH | 578983 | 8/1976 | |
| DE | 2134012 | 11/1972 | |
| DE | 3508195 | 9/1986 | |
| DE | 3508195 A * | 9/1986 | ..... B66C/17/00 |
| DE | PS 42 24 253 C1 | 3/1994 | |
| DE | OS 44 42 265 A1 | 5/1996 | |
| DE | PS 44 20 771 C2 | 10/1996 | |
| JP | 6-39997 | 2/1994 | |
| JP | 7-165064 | 6/1995 | |
| WO | 94/18007 | 8/1994 | |

* cited by examiner

*Primary Examiner*—Eileen D. Lillis
*Assistant Examiner*—Michael Lowe
(74) *Attorney, Agent, or Firm*—D. Peter Hochberg; Sean Mellino; Katherine R. Vieyra

(57) ABSTRACT

In a device according to the invention for the automatic charging of processing stations (1) with printing cylinders (9) a number of charging stations (2) is provided, each being designed as input location for entering the printing cylinder (9) into the device, as storing location for storing the printing cylinder (9) before and after processing, and as output location for delivering the printing cylinder (9) from the device after processing. The printing cylinders (9) may each be supplied to the processing station (1) by means of a crane (3) without being required that the operator must wait at the device until the crane has terminated its operation.

13 Claims, 4 Drawing Sheets

DEVICE AND METHOD FOR THE AUTOMATIC CHARGING OF PROCESSING STATIONS WITH PRINTING CYLINDERS

BACKGROUND OF THE INVENTION

1. Field of the Invention

The invention refers to a device and a method for the automatic charging of processing stations with printing cylinders.

2. Description of the Prior Art

While being manufactured, printing cylinders for rotary printing machines are conducted to various processing stations where they are covered, for example, either with chrome or copper, or where they are polished. For this purpose, so-called automatic lines are known, e.g. from the U.S. Pat. No. 5,336,898, comprising processing steps of mostly automated kind running in accordance with a special operating program. Usually, the printing cylinders are inserted into cylinder-conveying trolleys and transported manually to an input location which includes a centering means. The printing cylinder is centered by said centering means on a so-called centerline which is the centering line for all processing stations. The operator has the possibility to enter the required processing data, such as cylinder dimensions and desired operating programs, via the input location. Thereafter, a crane approaches the input location, centers a suitable holding device by means of the bearing journals or the face of the printing cylinder, lifts the printing cylinder from the trolley and conveys it either directly to a first processing station or to a storing location where the printing cylinder is stored until the respective processing station has been cleared.

After processing, the crane transports the printing cylinder from the processing station to a storing location where the printing cylinder is stored until called by the operator. To deliver a cylinder from the automatic line, the operator must first of all find the storing location of the desired cylinder and then give the order to evacuate same via the control. Subsequently, the operator must wait at an output location which is mostly identical with the input location until the crane has taken the processed printing cylinder from the storing location and dropped it at the output location.

It is, thus, disadvantageous for the described device that on the one hand, the operator must wait while he inserts the printing cylinder into the automatic line until taken by the crane and, on the other hand, that another waiting time is required until the crane has returned the printing cylinder from the machine to the conveying trolley. Depending on the operating conditions of the device, such waiting times may be rather considerable.

SUMMARY OF THE INVENTION

It is the object of the invention to improve a device of the described kind so that undesired waiting times for the operator can be avoided.

According to the invention, this object is solved by a device comprising the features of claim 1. An inventive method has been defined in claim 11. Further advantageous developments of the invention can be learned from the dependent claims.

A device according to the invention for charging at least one processing station with at least one printing cylinder, comprising a number of stationary charging stations, each being designed as input location for inserting the printing cylinder into the device, as storing location for storing the printing cylinder before and after processing, and as output location for delivering the printing cylinder from the device after processing, and further comprising a transportation equipment for conveying the printing cylinder between one of said charging stations and the at least one processing station is characterized in that the charging stations may each receive a conveying means on which the printing cylinder is mounted in detachable manner for transportation outside the device.

This means that the storage locations known so far are now being designed so that each individual storage location may additionally also serve as input and output location, thereby allowing a fast input and output of the printing cylinder at any time, irrespective of the availability and capacity of the crane.

The conveying means may be, for example, a cylinder-conveying trolley. This allows the operator to insert the printing cylinder to be processed together with the conveying means into any input location and to enter the respective required processing data. The operator may then leave the input location, as the printing cylinder will be taken from the transportation equipment as soon as possible. After processing, the printing cylinder is returned to the same location by the transportation equipment and dropped to the conveying means where it can be stored until taken by the operator together with the conveying means.

It is especially advantageous if the charging stations each comprise a positioning means for positioning and holding the conveying means to ensure that the conveying means takes a defined position in the charging station and is maintained in this position. This is of special importance because finished printing cylinders are delivered to the conveying means automatically which requires an exact position of the conveying means.

In an especially advantageous embodiment of the invention, the positioning means comprises a brake equipment based on a magnetic principle. The conveying means, e.g. the cylinder conveying trolley, is maintained in its desired position by means of a magnet.

Preferably, the transportation equipment is a crane means comprising a cross arm or traversing saddle movable in axial direction of the printing cylinder, said cross arm being provided with a movable holding means for holding the printing cylinder at its both ends relative to the cross arm in axial direction of the printing cylinder. The holding means comprises two holding elements movably arranged towards each other and relative to the cross arm, thereby enabling that, first of all, one of said holding elements gets into contact with that side of the printing cylinder that is to be held by said element. The cross arm and the other holding element now move towards the first holding element until the other holding element gets into contact with another side of the printing cylinder. In case of correspondingly designed holding elements, e.g. in the form of clamping jaws or gripping means, the printing cylinder to be processed can be gripped firmly and lifted from the conveying means. The moving speeds of the cross arm and the other holding element are selected so that the other holding element moves relative to the cross arm at the same speed as the cross arm moves relative to the first holding element. It may thus be ensured that the printing cylinder is positioned symmetrically to the cross arm while being lifted from the conveying means.

Consequently, both holding elements move towards each other at a defined speed while the cross arm moves at the same speed towards the holding element already contacting the printing cylinder, thus causing that the holding element contacting the printing cylinder does not lose contact from the printing cylinder but stands still relative to the cylinder.

In a preferred embodiment of the invention the crane means is provided with a means for determining at least one dimension of the printing cylinder. This may be, e.g. a means as described in DE 42 24 253. The dimensions may not only refer to the cylinder diameter but also to the face lenght or the entire lenght of the cylinder.

A control means is used to enter a charging station address, the cylinder ratings and an operating program for the printing cylinder to be processed, respectively.

A method according to the invention for charging at least one processing station with at least one printing cylinder comprises the following steps:

providing a number of stationary charging stations serving as printing cylinder input, storing and output location, respectively;

providing a transportation equipment for conveying the printing cylinder between one of said charging stations and the at least one processing station;

positioning and holding a printing cylinder-carrying conveying means in one of said charging stations;

conveying the printing cylinder by the transportation equipment from the charging station to the processing station;

processing the printing cylinder in the processing station;

returning the printing cylinder from the processing station to the charging station and dropping the printing cylinder to the conveying means;

releasing the conveying means.

The method according to the invention allows the function as already described above according to which the printing cylinder can be moved to any charging station from which it is transported by the transportation equipment to the processing station. After processing and returning to the charging station, the printing cylinder is dropped to the conveying means where it is released and can be moved out of the machine.

Preferably, this method allows to process and simultaneously treat several printing cylinders, as the operator may insert further printing cylinders into the device or remove them therefrom independent of the crane operation.

It is of special advantage that—after having dropped the printing cylinder to the conveying means—the transportation equipment adjusts to the format of the printing cylinder to be conveyed next. This means that the holding means can already adjust itself to the following printing cylinder format even before the transportation equipment has reached the position required therefor.

BRIEF DESCRIPTION OF THE DRAWINGS

These and further features and advantages of the invention will be explained in detail by the accompanying figures of a preferred embodiment, wherein.

DESCRIPTION OF THE PREFERRED EMBODIMENTS

Figure 1:
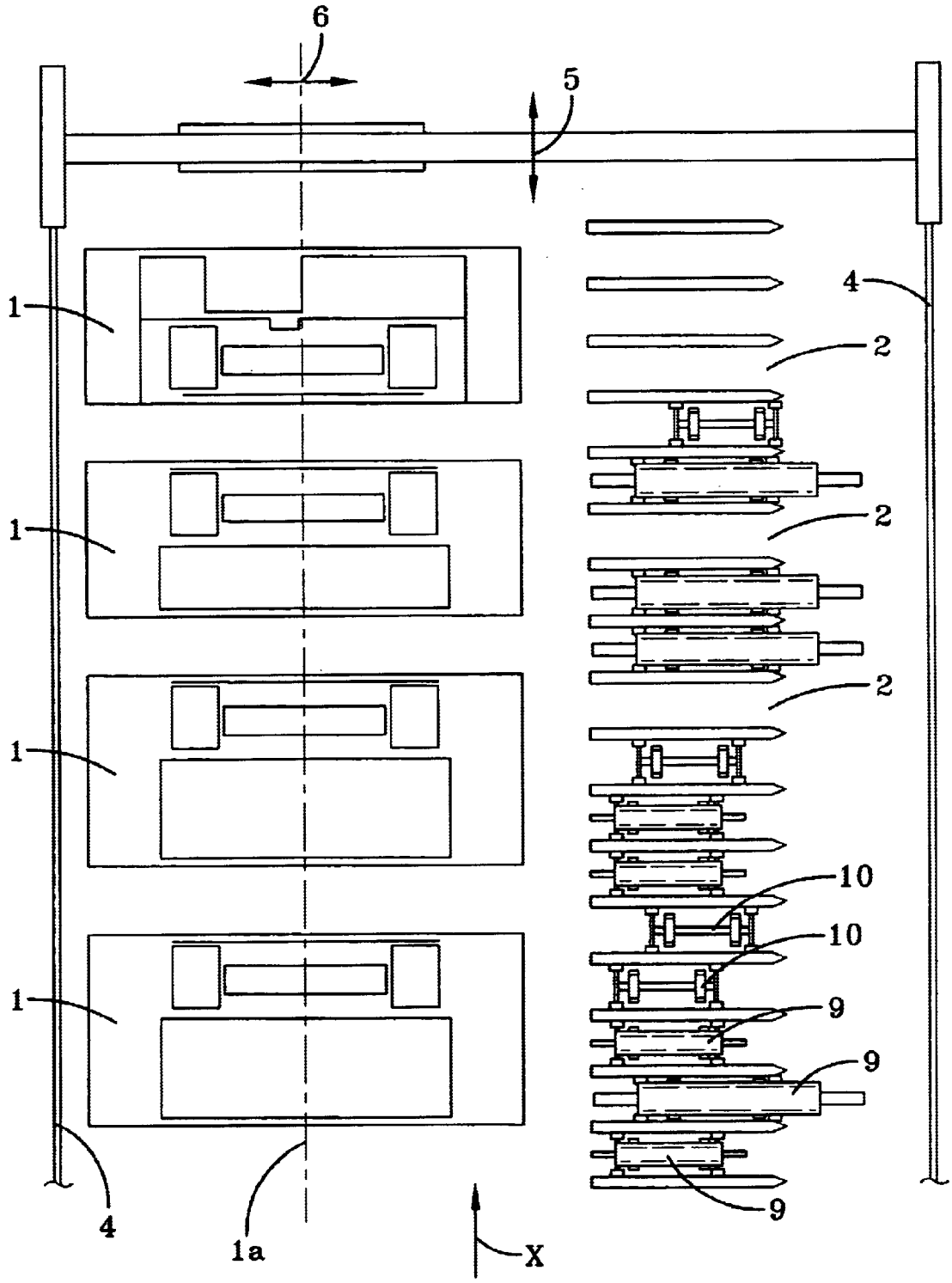
FIG. 1 is a plan view of the device according to the invention.

FIG. 1 is a plan view of a device according to the invention in form of an automatic line comprising a number of processing stations 1 arranged on a center line la and a number of charging stations 2. FIGS. 2 to 10 are side views of the device as seen from arrow X in FIG. 1.

The processing stations 1 may be commonly used electroplating baths, degreasing stations or polishing machines, etc.

Figure 2:
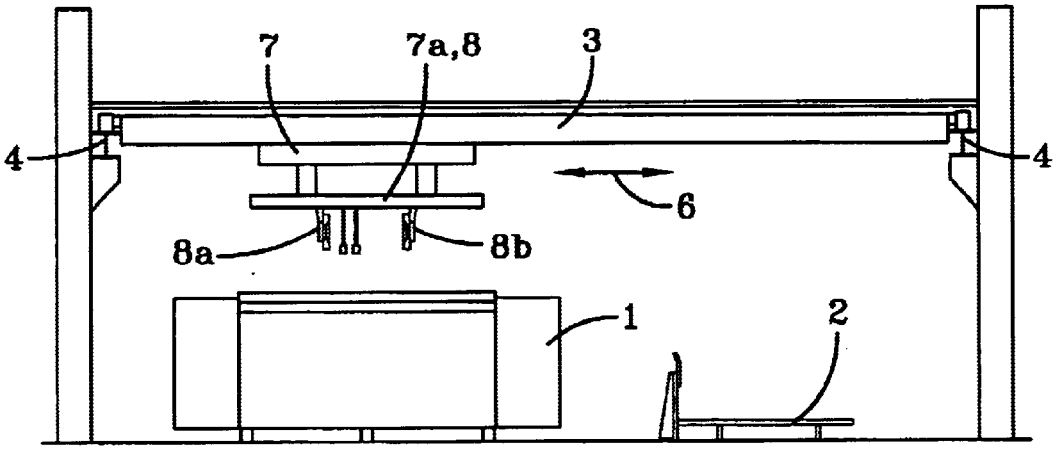
FIGS. 2 to 10 are side views of the device showing diverse operating steps to explain the inventive method for charging a processing station with a printing cylinder.

According to FIG. 2, a crane 3 can be moved on rails 4 in the direction of arrow 5 over the entire machine. The crane 3 supports a cross arm 7 moving back and forth in arrow direction 6 and having fixed to it—via a traversing saddle 7*a*—a clamping system 8 serving as holding means for the printing cylinder.

The charging stations 2 are arranged side by side in a number suitable for the machine. They simultaneously serve as input location for inserting the printing cylinders 9 to be processed into the device, as storing location for storing the printing cylinders 9 before and after processing, as well as output location for delivering the printing cylinders 9 from the device. According to FIG. 1, some charging stations 2 are uncharged, while other charging stations 2 already include printing cylinders 9 of partially different size.

The charging stations 2 can also be arranged in an extension of the axis of the processing stations 1 (in FIG. 1 above the processing stations 1).

The printing cylinders 9 may be axle cylinders as shown in the figures. Alternatively, hollow cylinders may also be used. In such a case, the centering means and the holding means should correspondingly be modified.

Figure 3:
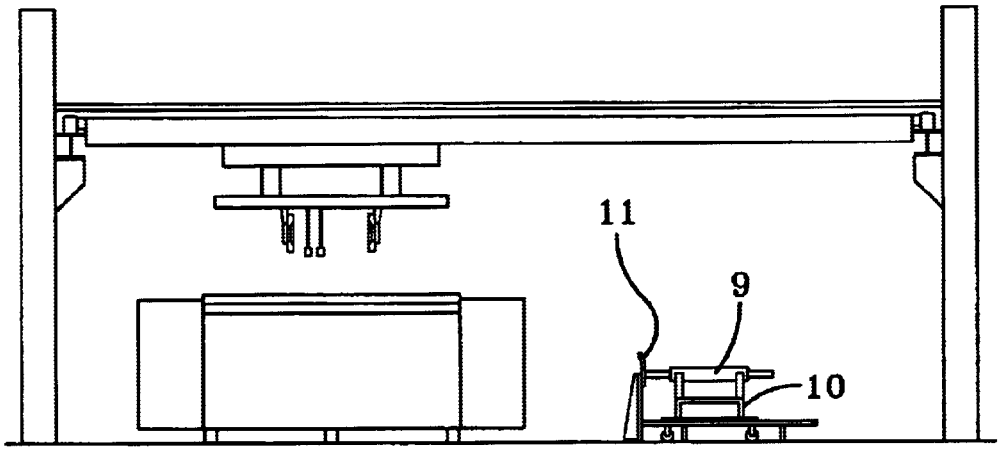

As can be seen, for example, in FIG. 3, the printing cylinders 9 are positioned on conveying or cylinder trolleys 10 and can be moved around in the factory by the operators. When a printing cylinder 9 is positioned into the device together with its conveying trolley 10, the conveying trolley 10 must be inserted into the charging station 2 until the cylinder axis abuts a stationary stopper 11. This does not depend on the length of cylinder 9 and its position on the trolley 10 so that a defined relative position of the printing cylinder 9 in the charging station 2 is determined in any case. The stopper 11 may for example be a pressure-sensitive sensor which responds upon contact of the cylinder axis.

As soon as the cylinder axis contacts the stopper 11, an automatic brake means which is not shown in the figure will become active (for example a magnet) and keeps the trolley 10 in its position until the printing cylinder 9 will be positioned again on the conveying trolley 10 after being processed.

The following describes by means of FIGS. 2 to 10 how a printing cylinder 9 is charged to a processing station 1.

FIG. 2 shows the original position. Since the components of the device which are identical to those of FIG. 1 were given the same reference numbers, it is refrained from describing said elements again.

The clamping system 8 includes two clamping jaws 8*a* and 8*b* which can be moved back and forth in arrow direction 6 relative to the cross arm 7.

Figure 4:
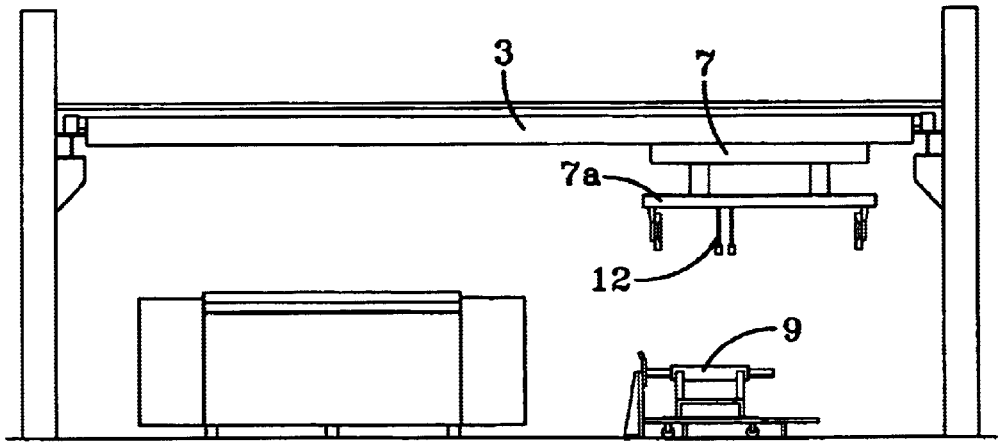
Figure 5:
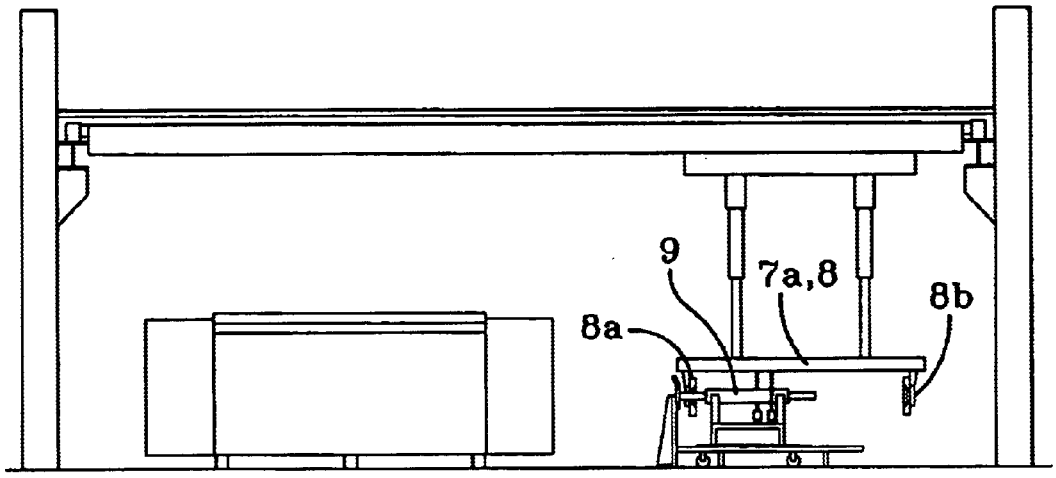

Further, the clamping system 8 is provided with a means 12, see e.g. FIG. 4, for the automatic determination of a printing cylinder diameter by means of a light barrier movable relative to printing cylinder 9.

According to FIG. 3, the printing cylinder 9 to be processed and placed on conveying trolley 10 has been inserted into the charging station 2 until the cylinder axis contacts the stopper 11.

According to FIG. 4, the cross arm 7 of the crane 3 moves to a position above the printing cylinder 9. According to FIG. 5, the traversing saddle 7*a* and, thus, the clamping system 8 are now lowering until the clamping jaws 8*a* and 8*b* have reached the same level like the cylinder axis.

Figure 6:
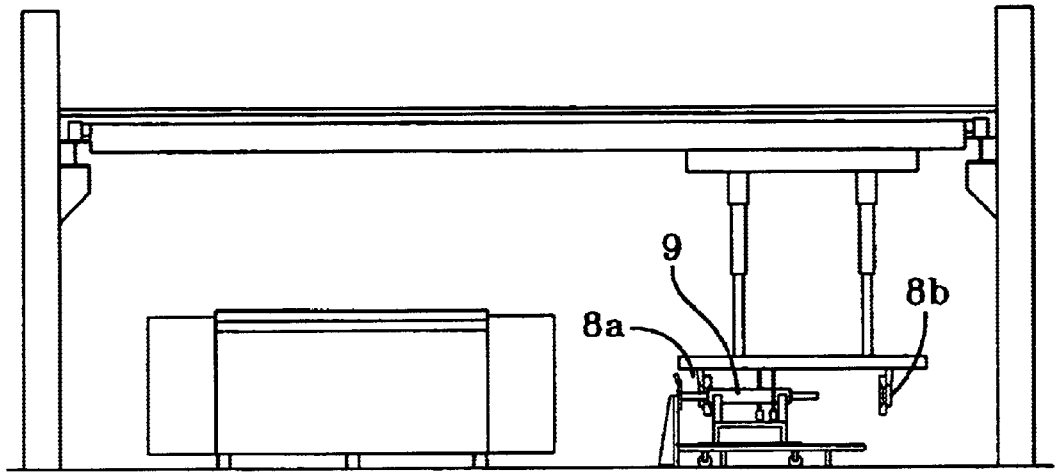

According to FIG. 6, the clamping jaws 8*a*, 8*b* are now moved together until the left clamping jaw 8*a* measures via an electronic means, e.g. a pressure sensor or a light barrier, that it abuts the face of printing cylinder 9.

Figure 7:
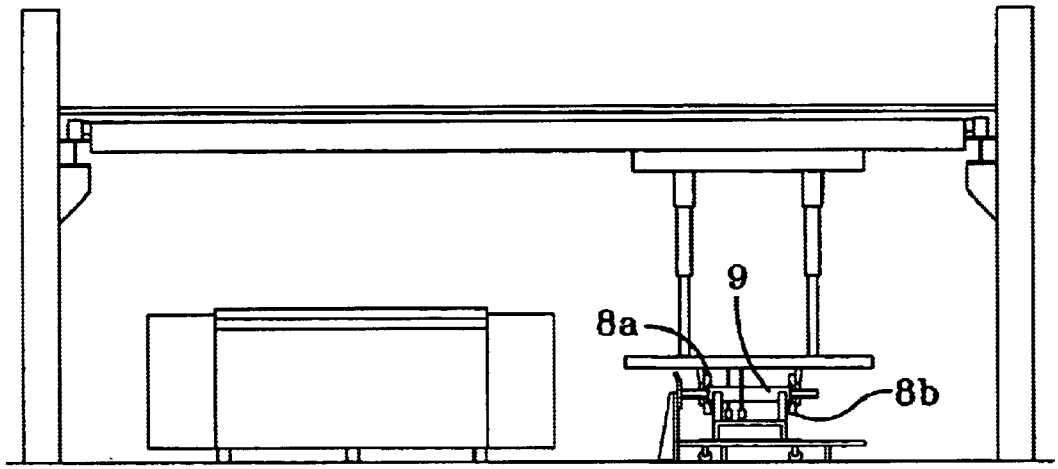

According to FIG. 7, the cross arm 7 also moves from that moment at the same speed as the clamping jaws 8*a*, 8*b* respectively move. In doing so, the left clamping jaw 8*a* keeps in contact with the face of printing cylinder 9 while the right clamping jaw 8*b* quickly approaches the other side of the face. As soon as the right clamping jaw 8*b* has also reached the face, the printing cylinder 9 is firmly clamped between both clamping jaws 8*a*, 8*b*. If required, the length of the face and the entire length of the printing cylinder 9 can be measured.

Figure 8:
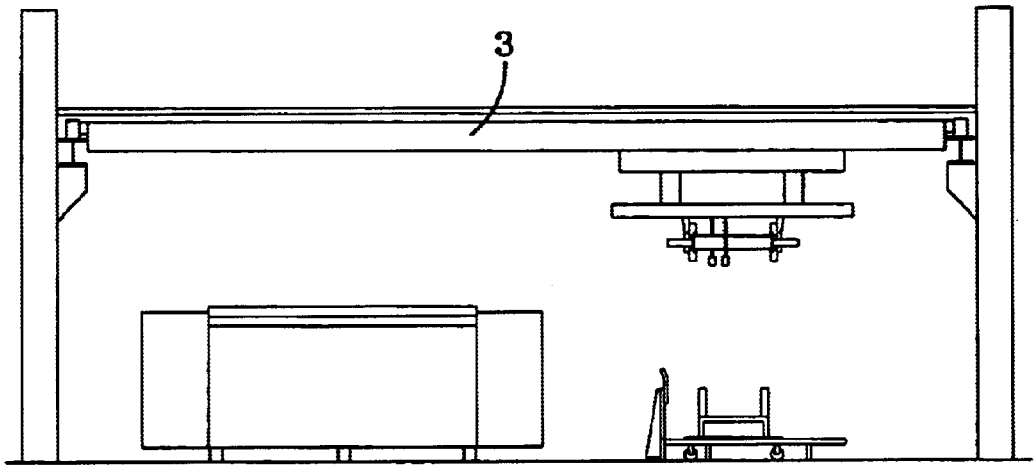
Figure 9:
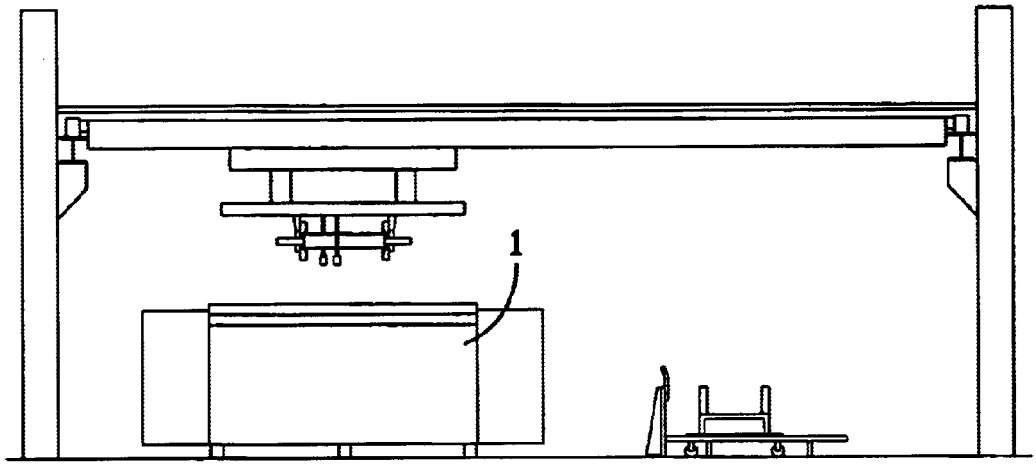
Figure 10:
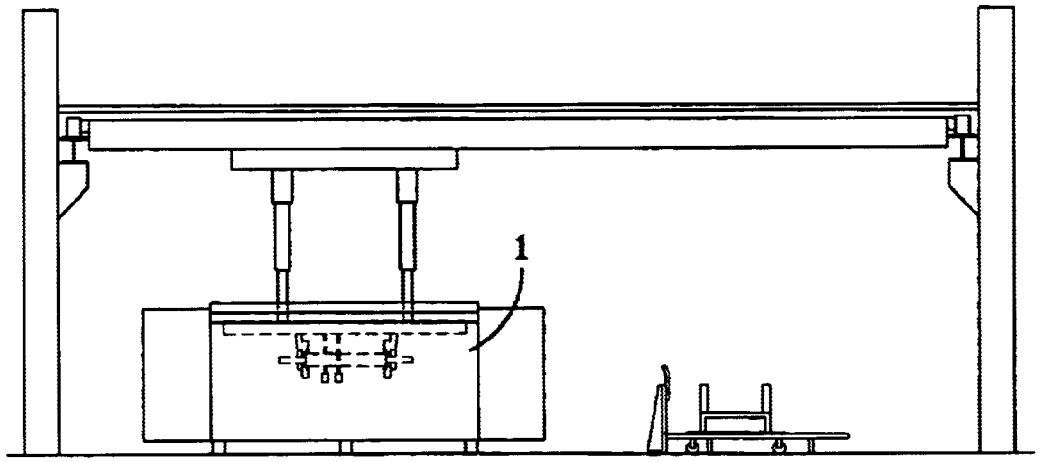

According to FIG. 8, the printing cylinder 9 is now lifted by the crane 3 and moved, according to FIG. 9, to processing station 1 where it is dropped, according to FIG. 10, to corresponding holding means provided in processing station 1.

In order to move the printing cylinder 9 between different processing stations 1, it is lifted again by the crane 3 and conveyed to the next processing station 1.

After processing, the printing cylinder 9 is lifted by the crane 3 from the processing station and returned to the conveying trolley 10 where the printing cylinder 9 may be stored until the operator has time to move the conveying trolley 10 together with the printing cylinder 9 from the charging station 2 to the next processing station. As soon as the printing cylinder 9 has been dropped to the conveying trolley 10, the trolley brake (not shown in the figures) will be released.

Instead of the above-described clamping system 8 the crane 3 may also be provided with a gripping system for gripping and lifting the cylinder axes. However, said gripping system basically works like the clamping system 8.

The entire device is coordinated by a control means (not shown) which is operable via a master console. The operator may use said master console to manually enter the number of the charging station into which he inserted the printing cylinder 9, as well as the cylinder-accompanying card by means of a barcode reader or the cylinder data (at least the length, the face length and the periphery). In addition, the operator enters the operating program, e.g. by the thickness of the copper or the chrome layer, or the polishing program, etc. Furthermore it is possible to influence the processing sequence by entering the priority.

To spare additional time, the clamping jaws 8*a*, 8*b* may already be moved towards or away from each other while the crane 3 and the cross arm 7 are still approaching the next charging station 2.

As already described, a means 12 may be used for the automatic determination of the diameter of the printing cylinder 9 to be lifted. Said means 12 includes at least one light barrier which can be moved by means of the crane 3 relative to the printing cylinder 9 to be determined in its radial or axial direction. As the printing cylinder 9 may not only be identified by the light barrier 12 in the direction of diameter but also in longitudinal direction, it is possible to measure or calculate not only the cylinder diameter but also the face length and—considering the distance between the longitudinal center of cylinder 9 and the stopper 11—the entire length of the printing cylinder 9. The data obtained may be compared to the data already stored in the control, thereby enabling a reasonableness check. In addition, it is also possible to select and suggest, in dependency of the detected printing cylinder dimensions, the suitable operating program.

If hollow cylinders (cylinders with no axes) are to be positioned in the line instead of the axle cylinders 9 shown in the figures, the stopper 11 cannot be used. In such a case it would suffice to move the trolley together with the hollow cylinder into the input location without being required to be positioned exactly. It is only required that the trolley stands in a prescribed area. The further procedure corresponds to the above-described: the holding elements 8*a*, 8*b* are in an outer basic position, the crane 3 lowers and detects the diameter and the center axis. Now, the holding elements or clamping jaws 8*a*, 8*b* (so-called Chinese hats) move towards each other until either the right or the left holding element contacts either the right or the left end of the cylinder (light barrier). From this moment, the cross arm 7 moves to the left at the same speed if the left holding element contacts the cylinder first, or to the right if the right holding element 8*b* contacts it first, thereby causing that the first-contacting holding element stands still in relation to the contacted face end. As soon as both holding elements contact the cylinder, the length of the face and the position of the cylinder will be known.

The invention has been described with particular emphasis being placed on the preferred embodiment, but variations and modifications may occur to those skilled in the art after a review of the specification and the appended claims.

What is claimed is:

1. A device for charging at least one processing station with at least one printing cylinder, comprising a number of stationary charging stations, each charging station being designed as an input location for inserting the printing cylinder into the device, as a storing location for storing the printing cylinder before and after processing, and as an output location for delivering the printing cylinder from the device after processing; and further comprising a transportation equipment for conveying the printing cylinder between one of said charging stations and the at least one processing station, wherein the charging stations each receive a conveying means on which the printing cylinder is mounted in detachable manner for transportation outside the device, and the charging stations each comprise a positioning means for positioning and holding the conveying means.

2. The device as set forth in claim 1, wherein the positioning means includes a brake means.

3. The device as set forth in claim 2, wherein the brake means is based on a magnetic principle.

4. The device as set forth in claim 1, wherein a control means is used to enter a charging station address, the cylinder ratings or an operating program for the printing cylinder to be processed.

5. The device as set forth in claim 1, wherein the transportation equipment is a crane means.

6. The device as set forth in claim 5, wherein the crane means includes a cross arm which can be moved in an axial direction of the printing cylinder and is provided with a movable holding means for holding the printing cylinder at both ends relative to the cross arm in the axial direction of the printing cylinder.

7. The device as set forth in claim 6, wherein the holding means includes two holding elements movable towards each other and relative to the cross arm.

8. The device as set forth in claim 7, wherein the holding elements call be moved towards each other via the cross arm positioned above the printing cylinder so that if one of the holding elements is in a holding position relative to the printing cylinder, the cross arm can be moved towards said holding element at a special speed relative to the printing cylinder and, simultaneously, the other holding element can be moved at the same speed relative to the cross arm towards the first holding element.

9. The device as set forth in claim 5, wherein the crane means is provided with a means for determining at least one dimension of the printing cylinder.

10. A method for charging at least one processing station with at least one printing cylinder, comprising the following steps:

a) providing a number of stationary charging stations serving as printing cylinder input, storing and output location, respectively;

b) providing a transportation equipment for transporting the printing cylinder between one of said charging stations and the at least one processing station, c) positioning and holding a printing cylinder-carrying conveying means in one of said charging stations;

d) transporting the printing cylinder by the transportation equipment from the charging station to the processing station;

e) processing the printing cylinder in the processing station;

f) returning the printing cylinder from the processing station to the charging station and dropping the printing cylinder to the conveying means; and g) releasing the conveying means, wherein steps c) to g) are repeated in order to process several printing cylinders, steps c) and g) being operable for several charging stations involved, independent of steps d) to f), and the transportation equipment adjusts to the format of the printing cylinder to be transported next as soon as the previous printing cylinder has been dropped to the conveying means.

11. The method as set forth in claim 10, comprising the following steps:

a) providing the transportation equipment with a cross arm and a holding means including two holding elements;

b) moving the cross arm over the printing cylinder supported by the conveying means;

c) moving the holding means so that the holding elements are on the same level like the printing cylinder;

d) moving the holding elements in an axial direction of the printing cylinder towards each other until one of the holding elements contacts one side of the printing cylinder and thus reaches its target position;

e) moving the cross arm parallel to the cylinder axis towards the stationary holding element at a determined speed;

f) simultaneously moving the other holding element together with the cross arm parallel to the cylinder axis towards the stationary holding element and at the same speed relative to the cross arm; and g) stopping the movement of the cross arm and of the holding element of the holding element has reached the other side of the printing cylinder.

12. The method as set forth in claim 10, wherein at least one dimension of the printing cylinder is determined between steps c) and d) by a means for automatically determining the at least one dimension of the printing cylinders.

13. The method as set forth in claim 12, wherein the means for determining the dimension is moved along the printing cylinder by the transportation equipment.

* * * * *